US005618010A

United States Patent [19]

Pla et al.

[11] Patent Number: 5,618,010

[45] Date of Patent: Apr. 8, 1997

[54] ACTIVE NOISE CONTROL USING A TUNABLE PLATE RADIATOR

[75] Inventors: Frederic G. Pla, Nashotah, Wis.; Harindra Rajiyah, Clifton Park, N.Y.

[73] Assignee: General Electric Company, Schenectady, N.Y.

[21] Appl. No.: 359,161

[22] Filed: Dec. 19, 1994

[51] Int. Cl.[6] ..... G10K 11/16

[52] U.S. Cl. ..... 244/1 N; 181/206; 381/71; 381/96; 381/171; 415/119

[58] Field of Search ..... 244/1 N; 415/119; 381/86, 171, 96, 71, 152; 181/206

[56] References Cited

U.S. PATENT DOCUMENTS

| | | |
|---|---|---|
| 1,688,743 | 10/1928 | Nicolson . |
| 4,551,849 | 11/1985 | Kasai et al. . |
| 4,700,177 | 10/1987 | Nakashima et al. . |
| 4,715,559 | 12/1987 | Fuller . |
| 4,751,419 | 6/1988 | Takahata . |
| 4,947,434 | 8/1990 | Ito . |
| 5,031,222 | 7/1991 | Takaya . |
| 5,370,340 | 12/1994 | Pla . |

FOREIGN PATENT DOCUMENTS

| | | |
|---|---|---|
| 2124598 | 5/1990 | Japan . |

OTHER PUBLICATIONS

Concurrently filed U.S. patent application RD–23664, Frederic G. Pla, entitled "Noise Control Using a Plate Radiator and an Acoustic Resonator".

Concurrently filed U.S. patent application RD–23569, Frederic G. Pla, entitled "Active Noise Control Using and Array of Plate Radiators and Acoustic Resonators".

U.S. patent application Ser. No. 08/143,602, filed Nov. 1, 1993, Frederic G. Pla et al., entitled "Active Noise Control Using Noise Source Having Adaptive Resonant Frequency Tuning Through Stiffness Variation".

U.S. patent application Ser. No. 08/143,605, filed Nov. 1, 1993, Frederic G. Pla et al., entitled "Active Noise Control Using Noise Source Having Adaptive Resonant Frequency Tuning Through Stress Variation".

U.S. patent application Ser. No. 08/143,604, filed Nov. 1, 1993, Frederic G. Pla et al., entitled "Active Noise Control Using Noise Source Having Adaptive Resonant Frequency Tuning Through Variable Panel Loading".

U.S. patent application Ser. No. 08/143,603, filed Nov. 1, 1993, Frederic G. Pla et al., entitled "Active Noise Control Using Noise Source Having Adaptive Resonant Frequency Tuning Through Variable Ring Loading".

See "Background of Invention" in present application.

U.S. patent application RD–23528, Frederic G. Pla et al., entitled "Active Noise Control of Aircraft Engine Discrete Tonal Noise" (filing receipt not yet received).

*Primary Examiner*—Galen L. Barefoot

*Attorney, Agent, or Firm*—Douglas E. Erickson; Marvin Snyder

[57] ABSTRACT

An active noise control subassembly for reducing noise caused by a source (such as an aircraft engine) independent of the subassembly. A noise radiating panel is bendably vibratable to generate a panel noise canceling at least a portion of the source noise. A piezoceramic actuator plate is connected to the panel. A back plate is spaced apart from the first plate and the panel with the panel positioned between the source noise and the back plate. A pair of spaced-apart side walls each generally abut the panel and the back plate so as to generally enclose a back cavity. A mechanism is provided for varying the panel resonating frequency by varying the state of the back cavity (such as by varying its fluid pressure and/or volume) while the panel is undergoing bending vibrations.

1 Claim, 4 Drawing Sheets

ACTIVE NOISE CONTROL USING A TUNABLE PLATE RADIATOR

This invention described herein was made in the performance of work under NASA Contract No. NAS3-26617 and is subject to the provisions of Section 305 of the National Aeronautics and Space Act of 1958 (42 U.S.C. 2457).

BACKGROUND OF THE INVENTION

The present invention relates generally to reducing noise from a source, and more particularly to an active noise control subassembly capable of generating a canceling noise to offset such source noise.

A noise source may produce discrete tonal noise (having one or more discrete frequencies), narrowband noise, and/or broadband noise. Noise sources include, but are not limited to, medical MRI (magnetic resonance imaging) systems and aircraft engines. Aircraft engines especially produce discrete tonal noise from fans and turbines. Such noise from larger aircraft engines, presently under development, may pose a problem in the vicinity of airports during aircraft take off and landing operations. Also, future aircraft noise regulations may pose a problem for existing aircraft engines.

Known passive noise control techniques for reducing aircraft engine noise include noise absorbing liners and tuned resonators usually mounted at the engine inlet and outlet to reduce the level of discrete tonal noise radiated outside the engine. However, the effectiveness of passive noise control treatment would be greatly reduced for engines with large fan diameters because of the lower fan blade passage frequency.

Known active noise control techniques for reducing aircraft engine discrete tonal noise generate a canceling noise forward and aft of the fan. The frequency of the canceling noise is equal to the blade passage frequency (and/or multiples thereof) as determined from engine speed using a tachometer. The amplitude and phase of the canceling noise is determined by a computer using feedback and/or feedforward control techniques with sound inputs from a microphone array disposed in the vicinity of the fan and the canceling noise such that the canceling noise is generally equal in amplitude and opposite in phase to the engine's discrete tonal noise. It is noted that known active noise control techniques reduce narrowband noise from a source by generating a narrowband canceling noise and reduce broadband noise from a source by reducing a narrowband portion thereof. Conventional techniques for generating the canceling noise include using piezoceramic actuator plates to bendably vibrate a panel to produce the canceling noise. The panel may be a part of the aircraft engine, such as a part of the fan shroud, or the panel may be a member which is separate from, but attached to, the aircraft engine. The piezoceramic plate is driven by an electric AC signal such that when the signal is positive, the plate causes the panel to bendably deflect in a first direction from its resting state, and when the signal is negative, the plate causes the panel to bendably deflect in the opposite direction. The panel is usually driven at its resonance frequency. What is needed is an active noise control subassembly which provides for variable tuning of the resonance frequency of the panel to increase its usable frequency bandwidth.

SUMMARY OF THE INVENTION

It is an object of the invention to provide an active noise control subassembly, wherein the subassembly is capable of generating a canceling noise having a resonance frequency which can be varied during subassembly operation as required by an active noise control system for reducing noise produced by a source such as an aircraft engine.

The active noise control subassembly of the invention is for reducing source noise caused by a source independent of the subassembly. The subassembly includes a noise radiating panel and a first piezoceramic actuator plate. The panel has first and second generally opposing sides and is bendably vibratable to generate a panel noise canceling at least a portion of the source noise. The first plate is connected to the first side of the panel such that vibrations in the first plate cause bending vibrations in the panel. The subassembly also includes a back plate spaced apart from the first plate and the panel with the panel positioned generally between the source noise and the back plate. The subassembly further includes a first pair of spaced-apart side walls each generally abutting the panel and the back plate so as to generally enclose a back cavity. A mechanism is provided to vary the panel resonating frequency by varying the state of the back cavity while the panel is undergoing the bending vibrations.

In a preferred embodiment, the mechanism varies the fluid pressure and/or volume of the back cavity while the panel is undergoing the bending vibrations.

Several benefits and advantages are derived from the invention. The mechanism allows the panel resonance frequency to be varied during operation of the active noise control subassembly. Thus, by using adaptive control techniques, a vibrating panel can be used, for example, to cancel the blade passage frequency noise of the fan of an aircraft engine as the fan changes its rotational speed during engine operation, as can be appreciated by those skilled in the art.

BRIEF DESCRIPTION OF THE DRAWINGS

The accompanying drawings illustrate a preferred embodiment of the present invention wherein.

DETAILED DESCRIPTION OF THE INVENTION

Figure 1:
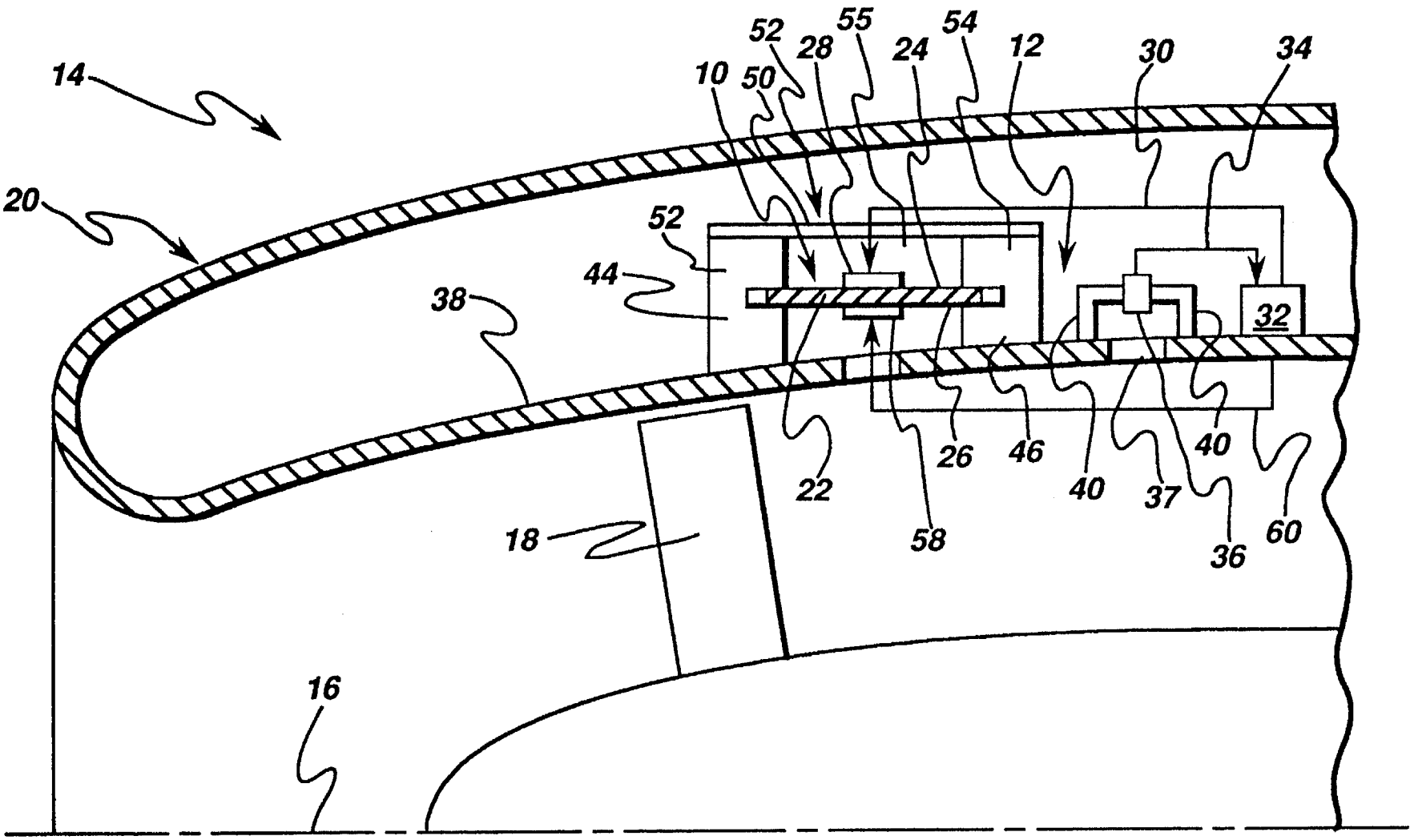
FIG. 1 is a schematic side-elevational, cross-sectional view of a front portion of an aircraft engine including a preferred embodiment of the active noise control subassembly of the invention.

Referring now to the drawings, wherein like numerals represent like elements throughout, FIG. 1 shows a preferred embodiment of the active noise control subassembly 10 of the present invention. The active noise control subassembly 10, which is part of an active noise control system 12, is for reducing source noise caused by a source independent of the subassembly 10. The invention will be described in terms of the noise being discrete tonal noise having one or more discrete frequencies and the source being an aircraft engine 14 (only the front portion of which is shown in FIG. 1). However, it is understood that the noise can also be narrowband and/or broadband noise and the source can be any source of noise. The aircraft engine 14, which has a generally longitudinally extending centerline 16, includes a fan 18 which rotates within a fan nacelle 20 producing discrete tonal noise predominately at the blade passage frequency and multiples thereof, as can be appreciated by those skilled in the art. It is noted that aircraft engines without fans also produce discrete tonal noise, such as, but not limited to, noise coming from their turbine blades (such turbine blades being omitted from FIG. 1 for clarity). It is noted that the blade passage frequency changes as the rotational speed of the fan changes during engine operation. For example, fan speed typically is higher during takeoff than during landing.

The active noise control subassembly 10 includes a noise radiating panel 22 bendably vibratable to generate a panel noise canceling at least a portion of the source noise (e.g., the discrete tonal noise of the aircraft engine 14). In some applications, such as that shown in FIG. 1, the noise radiating panel 22 is a separate member (such as a sheet of 1.5 millimeter thick aluminum) specifically installed in the aircraft engine 14 for noise control purposes. The noise radiating panel 22 has first and second generally opposing sides 24 and 26 and a panel resonating frequency.

The active noise control subassembly 10 also includes a first piezoceramic actuator plate 28 which is vibratable by a first applied electric AC signal 30 generated by a controller 32. The first piezoceramic actuator plate 28 is connected to the first side 24 of the noise radiating panel 22 such that vibrations in the first plate 28 cause bending vibrations in the panel 22. The first applied electric AC signal 30 generated by the controller 32 is such that the bending vibrations in the noise radiating panel 22 produce a panel noise canceling at least a portion of the source noise (e.g., panel noise which is generally opposite in phase to at least a portion of the discrete tonal noise of the aircraft engine 14). In an exemplary embodiment, such discrete tonal noise of the aircraft engine 14 is calculated by the controller 32 in part from engine speed (i.e., fan speed) measured by a tachometer (omitted from FIG. 1 for clarity) and in part from a signal 34 of aircraft engine noise from a microphone 36 disposed within the fan nacelle 20 over a sound port 37 in the inner wall 38 of the fan nacelle 20 and attached to supports 40 which are secured to the inner wall 38 of the fan nacelle 20. A best mode would use an array of microphones 36 flush mounted to the inner wall 38 (such arrangement not shown in the figures). The controller 32 may be a digital or analog computer or other control device, as is known to those skilled in the art. It is noted that the active noise control system 12 includes the active noise control subassembly 10, the microphone 36, the tachometer (omitted from FIG. 1 for clarity), and the controller 32. A best mode would employ a system 12 forward and aft of the fan 18. The panel 22 is in acoustic communication with a portion of the inner wall 38 of the fan nacelle 20. In a first preferred embodiment seen in FIG. 1, the panel 22 is supported by a portion of the inner wall 38 of the fan nacelle 20 through side supports 44 and 46 attached to such inner wall 38.

For purposes of describing the invention, the term "piezoceramic" refers to a material which exhibits a piezoelectric effect and is not limited to commonly called piezoceramic materials but also includes electrostrictive materials while excluding magnetostrictive materials. Typically, the first piezoceramic actuator plate 28 is a sheet (e.g., 50×50×0.25 millimeters) of piezoceramic material bonded to the fiat or curved noise radiating panel 22 using an epoxy or alkyl cyanolate compound. Vacuum pads or weights are sometimes used during the bonding process to apply a uniform pressure on the first plate 28, especially when bonding the plate to a curved panel surface. Preferably, a compressive prestress is created in the first plate 28 during the bonding process. A positive electric DC bias in the poling direction may also be added to the first applied electric AC signal 30.

Although not shown in the drawings, the active noise control subassembly 10 may include a (shaped) front plate having a sound exit port and further include side walls generally abutting the panel 22 and the front plate so as to generally enclose a front cavity to define a resonator having a resonating frequency which may be set equal to the panel resonating frequency and which may be varied by varying the volume of the front cavity and/or the area and/or thickness of the sound exit port.

Figure 2:
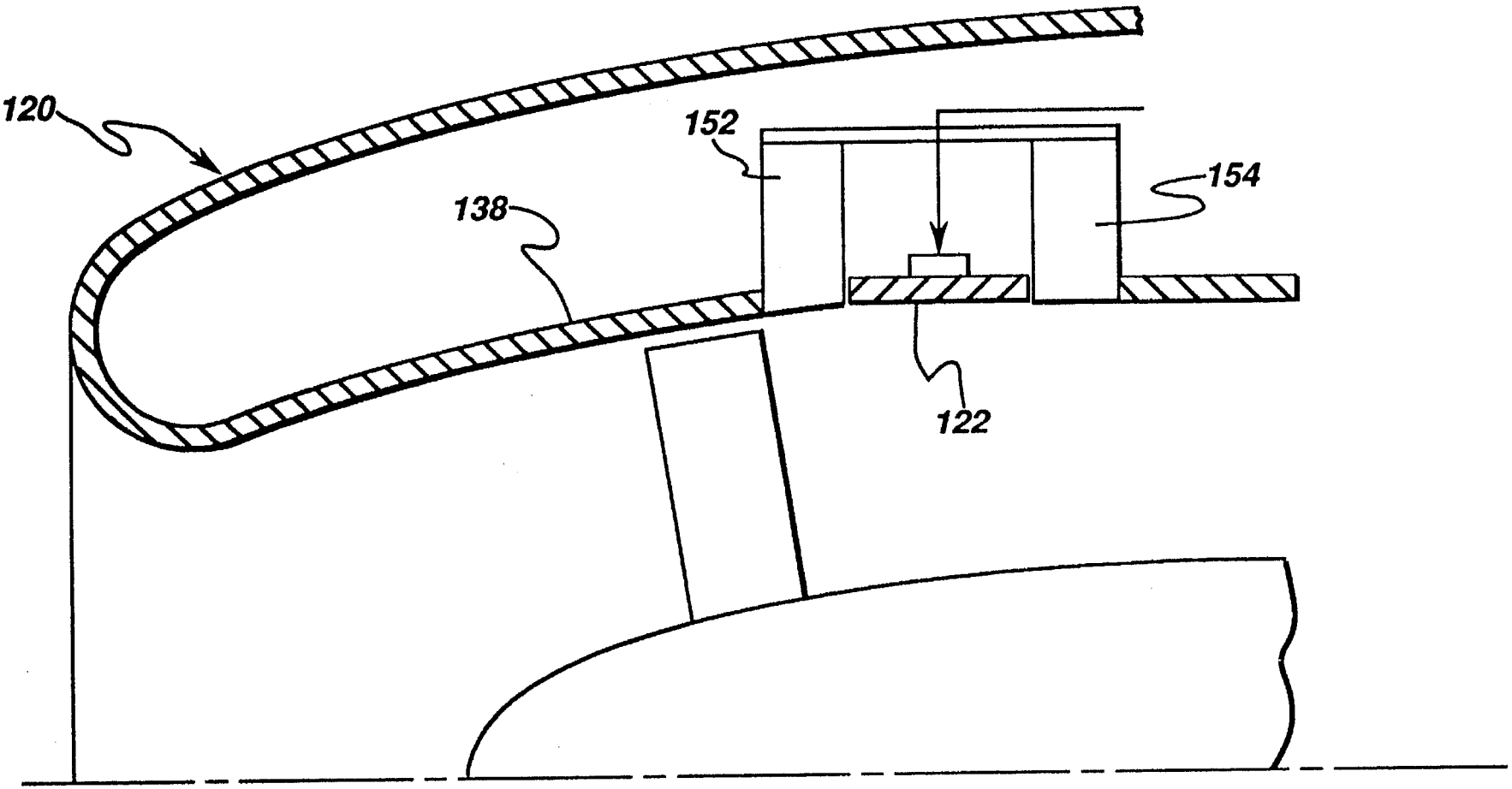
FIG. 2 is an enlarged view of the left portion of FIG. 1 showing a different embodiment of the active noise control subassembly of the invention.

As shown in FIG. 1, the subassembly 10 further includes a back plate 50 spaced apart from the first plate 28 and the panel 22 with the panel 22 disposed generally between the source noise and the back plate 50, and the subassembly 10 preferably further includes a pair of spaced-apart side walls 52 and 54 each generally abutting the panel 22 and the back plate 50 so as to generally enclose a back cavity 55 and define a chamber 56. It is noted that the spaced-apart side walls 52 and 54 are shown attached to the panel 22 in FIGS. 1 and 3–4. In an alternate embodiment, as shown in FIG. 2, the panel 122 is a portion of the inner wall 138 of the fan nacelle 120 and is not attached to the side walls 152 and 154 but is maintained in position by seals (not shown).

In a preferred embodiment, the active noise control subassembly 10 includes a second piezoceramic actuator plate 58 which is vibratable by a second applied electric AC signal 60 generated by the controller 32. The second piezoceramic actuator plate 58 is connected to the second side 26 of the noise radiating panel 22 such that vibrations in the second plate 58 cause bending vibrations in the panel 22. The second applied electric AC signal 60 generated by the controller 32 is such that the bending vibrations in the noise radiating panel 22 produce a panel noise canceling at least a portion of the source noise (e.g., panel noise which is generally opposite in phase to at least a portion of the discrete tonal noise of the aircraft engine 14). It is noted that the first and second piezoceramic actuator plates 28 and 58 are powered "out-of-phase" so that, for example, the first plate 28 expands while the second plate 58 contracts. When two piezoceramic actuator plates 28 and 58 are used, it is preferred that their combined effect results in causing bending vibrations in the noise radiating panel 22 which produce a canceling noise which is generally equal in amplitude to at least a portion of the aircraft engine discrete tonal noise. It is also preferred that when only one piezoceramic actuator plate 28 or 58 is used, its effect results in causing bending vibrations in the panel 22 which produce a canceling noise generally equal in amplitude to at least a portion of the aircraft engine discrete tonal noise.

In certain applications, an array (not shown in the figures) of subassemblies 10 may be used including a pair of subassemblies spaced apart to create a space between adjacent side walls of the pair and including a third subassembly stacked on top of the pair with the space defining the sound exit port of the third subassembly.

The active noise control subassembly 10 additionally includes means for varying the panel resonating frequency by varying the state of the back cavity 55 while the panel 22 is undergoing the bending vibrations so that the back cavity 55 serves as a tuning chamber. This allows the controller 32 to use adaptive control techniques to vary, for example, the frequency of the canceling noise from the panel 22 to match a changing frequency in the discrete tonal noise of the source (e.g., an aircraft engine 14).

Figure 3:
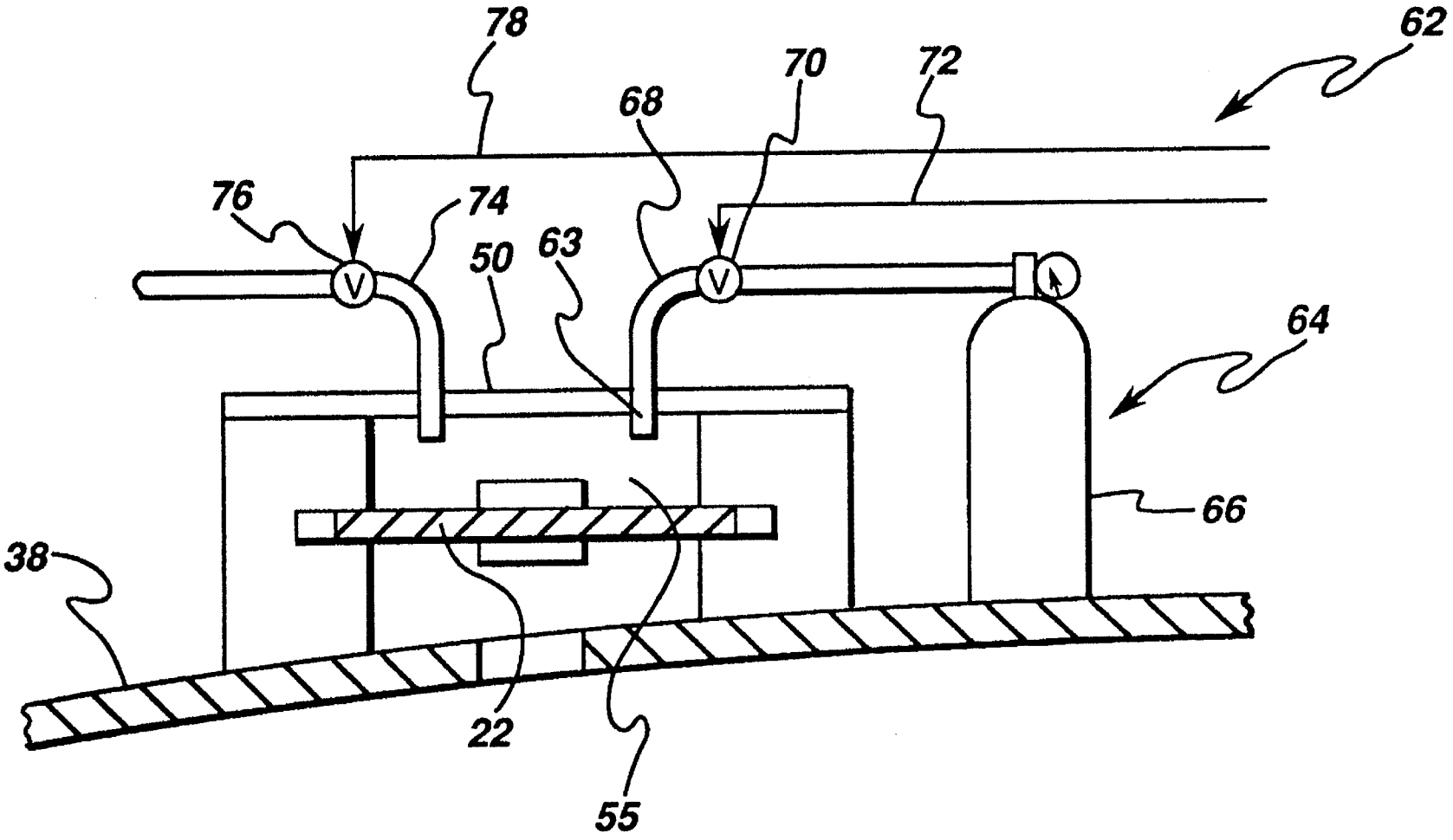
FIG. 3 is an enlarged view of the subassembly of FIG. 1 also showing a preferred embodiment for varying the fluid pressure of the back cavity.

In a first exemplary embodiment, as seen in FIG. 3, the back cavity 55 has a fluid pressure, and such frequency varying means includes means 62 for varying the fluid pressure of the back cavity 55 while the panel 22 is undergoing the bending vibrations. Preferably, the fluid pressure is air pressure, the back plate 50 has an orifice 63, and the fluid pressure varying means 62 includes a variable pressure air supply 64 disposed outside the back cavity 55, generally hermetically connected to the back plate 50, and in fluid communication with the orifice 63. The variable pressure air supply 64 includes a container of pressurized air 66, an air supply conduit 68 having a first pressure regulator valve 70 controlled by a first signal 72 from the controller 32, and an air exhaust conduit 74 having a second pressure regulator valve 76 controlled by a second signal 78 from the controller 32 (such origination of the first and second signals 72 and 78 from the controller 32 omitted from FIG. 3 for clarity). Other such fluid pressure varying means includes other suitable arrangements of pressure regulatory valves, conduits, pressure and vacuum pumps, and high and low pressure fluid containers as can be appreciated by those skilled in the art.

Figure 4:
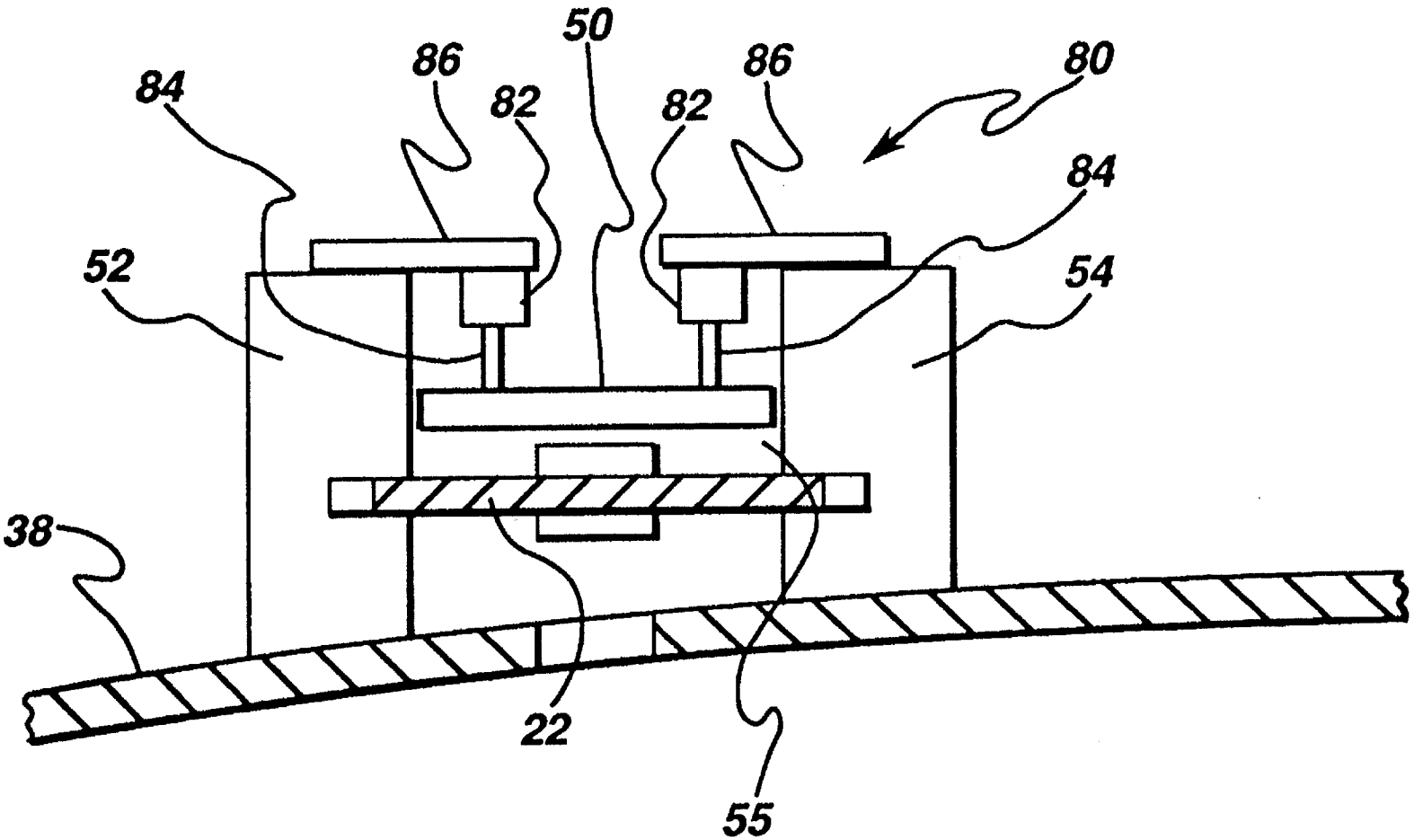
FIG. 4 is an enlarged view of the subassembly of FIG. 1 also showing a preferred embodiment for varying the volume of the back cavity.

In a second exemplary embodiment, as seen in FIG. 4, the back cavity 55 has a volume, and such frequency varying means includes means 80 for varying the volume of the back cavity 55 while the panel 22 is undergoing the bending vibrations. Preferably, the volume varying means 80 includes powered cylinders 82 for moving the back plate 50 towards and away from the panel 22. The powered cylinders 82 have movable pistons 84 attached to the back plate 50 and are themselves connected to the side walls 52 and 54 by support arms 86. Other volume varying means 80 includes movable or telescoping side walls and/or an inflatable diaphragm (not shown) disposed in the back cavity 55.

Other such means to have the back cavity serve as a tuning chamber for varying the panel resonating frequency by varying the state of the back cavity while the panel is undergoing the bending vibrations includes varying both the fluid pressure and the volume, varying the temperature within the back cavity 55, varying the fluid substance in the back cavity 55, and the like, as can be appreciated by those skilled in the art.

The foregoing description of a preferred embodiment of the invention has been presented for purposes of illustration. It is not intended to be exhaustive or to limit the invention to the precise form disclosed, and obviously many modifications and variations are possible in light of the above teaching. It is intended that the scope of the invention be defined by the claims appended hereto.

I claim:

1. An active noise control subassembly for reducing source noise caused by a source independent of said subassembly, said subassembly comprising:

a) a noise radiating panel bendably vibratable to generate a panel noise canceling at least a portion of said source noise, said panel having first and second generally opposing sides and a panel resonating frequency;

b) a first piezoceramic actuator plate connected to said first side of said panel such that vibrations in said first plate cause bending vibrations in said panel;

c) a back plate spaced apart from said first plate and said panel with said panel disposed generally between said source noise and said back plate;

d) a pair of spaced-apart side walls each generally abutting said panel and said back plate so as to generally enclose a back cavity which is not in fluid communication with said source noise; and e) means for varying said panel resonating frequency by varying the state of said back cavity while said panel is undergoing said bending vibrations, wherein said back cavity has a volume, wherein said frequency varying means includes means for varying said volume while said panel is undergoing said bending vibrations, wherein said source is an aircraft engine having a fan, wherein said panel is in acoustic communication with a portion of an inner wall of a fan nacelle, and wherein said volume varying means includes powered cylinders for moving said back plate towards and away from said panel.

* * * * *